US008562382B2

(12) United States Patent
Karlsson et al.

(10) Patent No.: US 8,562,382 B2
(45) Date of Patent: Oct. 22, 2013

(54) METHOD FOR SYSTEM FOR A WATER JET PROPULSION SYSTEM FOR A SHIP

(75) Inventors: Sven-Gunnar Karlsson, Kristinehamn (SE); Reima Aartojarvi, Kristinehamn (SE); Lars Andersson, Kristinehamn (SE)

(73) Assignee: Rolls-Royce Aktiebolag (SE)

( * ) Notice: Subject to any disclaimer, the term of this patent is extended or adjusted under 35 U.S.C. 154(b) by 121 days.

(21) Appl. No.: 12/934,098

(22) PCT Filed: Mar. 26, 2009

(86) PCT No.: PCT/SE2009/050318

§ 371 (c)(1), (2), (4) Date: Nov. 4, 2010

(87) PCT Pub. No.: WO2009/120143

PCT Pub. Date: Oct. 1, 2009

(65) Prior Publication Data

US 2011/0045717 A1 Feb. 24, 2011

(30) Foreign Application Priority Data

Mar. 27, 2008 (SE) ..... 0800687

(51) Int. Cl.
*B63H 11/00* (2006.01)

(52) U.S. Cl.
USPC ..... 440/38

(58) Field of Classification Search
USPC ..... 440/38–47
See application file for complete search history.

(56) References Cited

U.S. PATENT DOCUMENTS

| | | | | |
|---|---|---|---|---|
| 3,212,258 | A | 10/1965 | Gongwer | 60/35 |
| 5,634,831 | A | 6/1997 | Davies et al. | 440/47 |
| 6,193,569 | B1 * | 2/2001 | Davies et al. | 440/38 |
| 6,422,904 | B1 | 7/2002 | Davies et al. | 440/38 |

FOREIGN PATENT DOCUMENTS

| | | |
|---|---|---|
| JP | 06001288 | 11/1994 |
| JP | U-H06-87193 | 12/1994 |
| SU | 740606 | 6/1980 |
| WO | WO 98/21090 | 5/1998 |

OTHER PUBLICATIONS

International Search Report and Written Opinion for Application No. PCT/SE2009/050318 mailed Jul. 3, 2009.

(Continued)

*Primary Examiner* — Daniel Venne
(74) *Attorney, Agent, or Firm* — Eric L. Sophir; Dentons US LLP

(57) ABSTRACT

A system and method of starting a water jet propulsion system for a ship in which the propulsion system includes a stator shell adapted to be mounted to the hull and having a nozzle ending in an outlet with a cross-sectional outlet area, an impeller housing attached to the stator shell and having an upstream inlet, and an impeller rotatably mounted in the impeller housing for receiving water from the inlet and discharging it through the nozzle of the stator shell so as to create a water jet upon rotation of the impeller. The method includes reducing the outlet area by partly closing the nozzle during a start up phase of the water jet propulsion system, wherein there is provided a back flow hindering arrangement arranged to hinder air to enter into the impeller housing via the nozzle.

18 Claims, 2 Drawing Sheets

(56) References Cited

OTHER PUBLICATIONS

Japanese Rejection Notice in corresponding JP Application No. 2011-501749 on Jul. 30, 2013 in English and Japanese, 4 pages.

Japanese Utility Model Application No. 05-035155 published on Dec. 20, 1994 as Japanese Utility Model Application Publication No. 06-087193, English translation supplied by PAJ, 8 pages.

* cited by examiner

METHOD FOR SYSTEM FOR A WATER JET PROPULSION SYSTEM FOR A SHIP

TECHNICAL FIELD

The present invention relates to a system and method of starting a water jet propulsion system for a ship, said propulsion system including a stator shell adapted to be mounted to the hull and having a nozzle ending in an outlet with a cross-sectional outlet area, an impeller housing attached to the stator shell and having an upstream inlet, and an impeller rotatably mounted in the impeller housing for receiving water from the inlet and discharging it through the nozzle of the stator shell so as to create a water jet upon rotation of the impeller, said method including reducing the outlet area by partly closing the nozzle during a start up phase of the water jet propulsion system,

BACKGROUND ART

To start up a large water jet propulsion unit for a ship, there is a need to have sufficient water in the impeller housing and/or take special measures, to obtain propulsion. This problem does not exist in conjunction with most water jet crafts, but only for ships powered by water jet, where of some reason a substantial portion of the impeller housing at occasion will be positioned above the water line, i.e. the water jet unit is not wholly submerged but is only partly located under the surface. Then it is necessary to carry out what is commonly known as "priming", meaning that the impeller housing has to be filled with water, in connection with the start up phase, as is known per se.

In JP 7215294, a water jet propulsion unit is primed be means of vacuum from a tank connected to a vacuum pump, and further U.S. Pat. No. 3,970,027 discloses a priming means for a bow steering pump and utilizing a vacuum pump to fill the bow steering pump with water. Accordingly an additional pump has to be used which is costly and is also a risk factor from a view point of reliability.

JP 1262289 discloses a water jet propulsion unit, where quick starting is enabled by spraying a partial water jet pressurized by a pump impeller to the inside of a water duct of a front flow part of the pump impeller at the time of low headway by a water nozzle, and avoiding any cavitation at the pump suction side. Hence, also their solution uses additional machining causing the same disadvantage as mentioned above.

U.S. Pat. No. 5,634,831 discloses another known solution, that is complex and/or costly and that also includes aspects of uncertainty regarding reliability. It depicts a water jet propulsion unit using two counter rotating impellers. The nozzle section includes a throttled outlet to allow for a high mass/low pressure operation while maintaining pump priming. In one embodiment, the throttling device utilizes two spring-loaded flaps mounted inside the nozzle section upstream the ejection opening thereof and moving back into a recess provided in the wall of the nozzle section as the flow rate increases. In another embodiment, the throttling device includes a series of thin flexible strips fixed to a circular rim. A flexible rubber ring or a coil spring is provided at the free ends of the flexible strips to make the form a contracted nozzle opening. A thin rubber sleeve is fitted over the strips to prevent water loss when pressure increases and makes the nozzle opening expand.

JP-06-001288 shows a further known solution to assist in priming. Here a movable cone-shaped part is provided that is intended to be moved to a blocking position during priming, i.e. totally blocking the outlet. It is evident that such a solution is complex and costly. Moreover it requires complex control mechanisms, that are disadvantageous, not at least from the view point of reliability.

Further U.S. Pat. No. 6,422,904 B1 and WO 9821090, present known alternatives for enabling priming of a water jet propulsion unit. Both relate to small vessles using two counter rotating impellers and a spring-loaded flexible skirt, which helps to facilitate priming and control of pressure inside the unit. Also these latter solutions present disadvantages, and especially so in relation to larger water jet units.

DISCLOSURE OF THE INVENTION

The object of the present invention is to eliminate or at least minimize any of the disadvantages mentioned above, which is achieved by a method defined in claim 1. Thanks to the invention, somewhat surprisingly it is possible to accomplish the desired degree of priming without a need to totally physically block the outlet, based on the findings that sufficient priming is achieved by providing air back flowing means, that hinders air to enter into the impeller housing through the outlet during start up. By means of the invention it is possible to achieve successful priming in situations when the inlet of the impeller housing is submerged as little as 15% (of its vertical extension, i.e. diameter of inlet if circular), sometimes even down to or close to 10%.

In the method defined in the first paragraph above, this object is achieved in accordance with the present invention by providing an arrangement that is mounted at the nozzle outlet, which hinders air to back flow through the outlet, into the impeller housing, providing reliable and cost efficient solutions thanks to the finding in accordance with the invention that there is no need of totally physically blocking the outlet to achieve the desired hindering of air back flow, if a synergistic use of the jet stream out of the outlet nozzle is provided for, during the priming stage, to achieve said air back flow hindering. Further, according to a preferred aspect of the invention this in turn facilitates the use of hindering and/or blocking arrangements that are designed to be automatically "in-activated" by the jet stream as soon as its flow has increased sufficiently, i.e. as soon as priming has successfully been accomplished.

According to another aspect of the invention the arrangement comprises at least one blocking member movable between at least two positions, one adapted to block most of the outlet area, and the other adapted to avoid forming unnecessary flow restrictions at the nozzle outlet.

Thanks to the invention priming of a water jet propulsion system is easily and reliably achieved by means of a cost effective solution.

According to a further aspect of the invention, the object is achieved in that the water jet propulsion system comprises at least two pivotal flaps, which are mounted at the nozzle outlet and are movable between two end positions, one adapted to block most of the outlet area, and the other adapted to avoid forming unnecessary flow restrictions at the nozzle outlet.

BRIEF DESCRIPTION OF THE DRAWINGS

In the following, the invention will be described in more detail with reference to preferred embodiments and the appended drawings.

DETAILED DESCRIPTION

Figure 1:
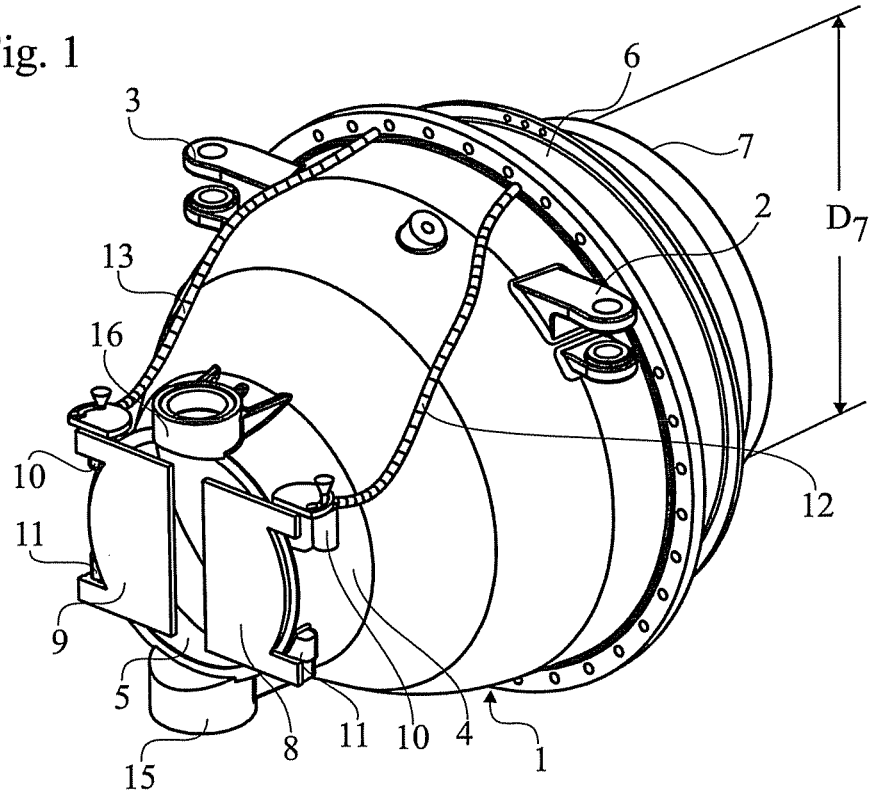
FIG. 1 is a perspective view of a preferred embodiment of a water jet propulsion unit according to the invention, including two pivotal flaps that are mounted at the nozzle outlet and are shown in their closed position, where they block most of the outlet area.
Figure 2:
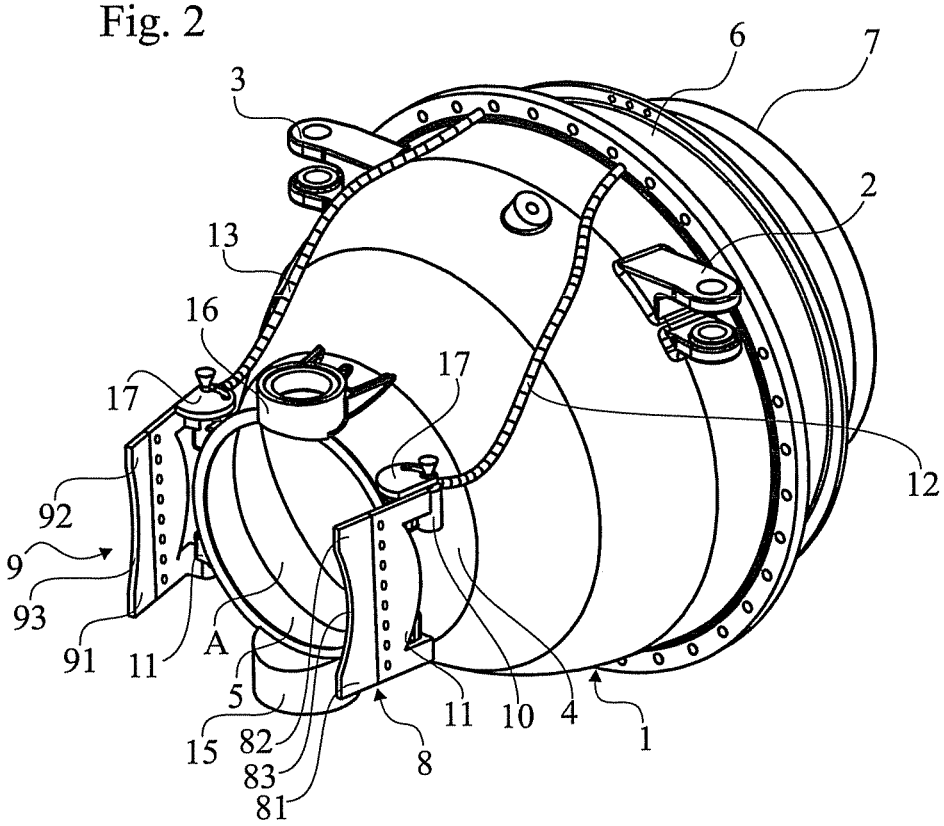
FIG. 2 is a is a perspective view of the water jet propulsion unit of FIG. 1, with two pivotal flaps, of a modified design, shown in their open position, where they avoid forming unnecessary flow restrictions at the nozzle outlet.
Figure 3:
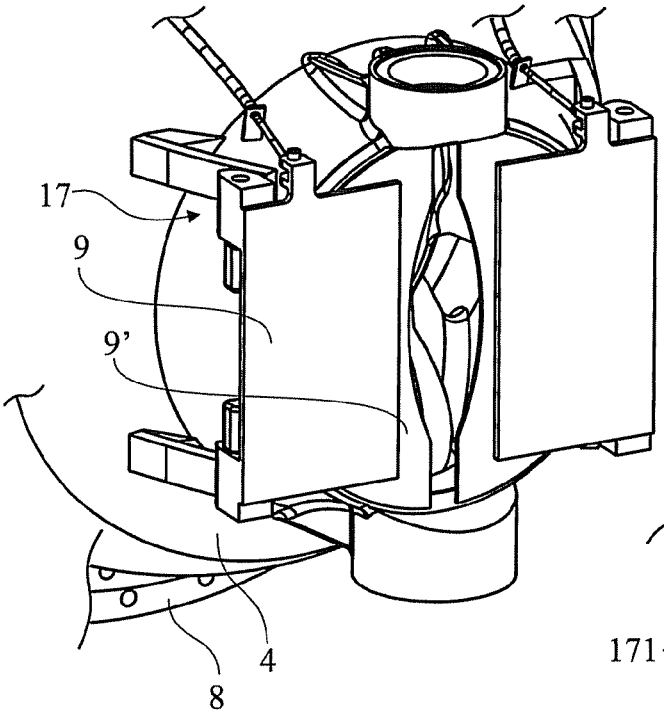
FIGS. 3 and 3*a* are detailed views of an embodiment of a resilient mechanism according to the invention.

The water jet propulsion units shown in FIGS. 1, 2 and 3 are adapted for use in ships and comprise a stator shell 1 adapted to be mounted to the rear portion of the hull, not shown, by having two brackets 2 and 3 symmetrically placed with reference to a vertical plane, not shown. The stator shell 1 has a nozzle 4 ending in an outlet 5 with a cross-sectional outlet area A. The water jet propulsion unit further comprises an impeller housing 6 that is attached to the stator shell 1 and has an upstream inlet 7, and an impeller, not shown, rotatably mounted in the impeller housing 6 for receiving water from the inlet 7 and discharging it through the nozzle 4 of the stator shell 1 so as to create a water jet upon rotation of the impeller, and means are provided, to hinder air from entering in through the outlet 5 into the impeller housing during a start up phase of the water jet propulsion system.

It is evident to the skilled person that priming, according to the invention, is merely needed in situations where the impeller housing is only partly submerged below a certain level. Normally there is no need of priming if the impeller housing is submerged to about 50%, i.e. that the vertically extending distance $D_7$ of the impeller inlet 7 is filled with water to at least 50%. Below a level of 50% many water jets, depending on the design of the impeller, will have problems during the start up phase. Indeed all water jets will encounter such problems if the level is very low. Tests have shown that in some installations it may be possible to accomplish a successful start up of the water jet having levels as low as about 10%, by means of the invention.

As shown in FIGS. 1 and 2 the hindering is achieved by partly blocking the nozzle 4 by means of two pivotal flaps 8, 9, which are mounted at the nozzle outlet 5 and are movable between two end positions, one adapted to block most of the outlet area, and the other adapted to avoid the forming of unnecessary flow restrictions at the nozzle outlet 5.

A major advantage of the invention is that there is no need for 100% blocking of the outlet 5, which leads to numerous possibilities to use various designs that may fulfill functionality in accordance with that principle. As a consequence very cost efficient solutions, compared to existing prior art, may be used. However, the basic principle of the invention does not exclude use of 100% blockage.

In the embodiment shown in FIGS. 1 and 2, the flaps 8 and 9 are hydraulically maneuverable and hinged on vertically arranged hinges 11 located on the exterior of the nozzle 4 adjacent the outlet 5. The hinges 11 preferably are arranged so as to form two vertically displaced pivot points, one upper and one lower. Hydraulic fluid is conducted from a suitable pump, not shown, through hoses 12 and 13 to housings 10, in each of which a small hydraulic motor, not shown, is integrated. Of course, if desired, it is possible to substitute the motors for pistons or any other conventional force transmitting means of sufficient power for the hydraulic system to maneuver the flaps 8 and 9.

The flaps 8 and 9 may be manually controlled or controlled by any conventional control unit, not shown.

In a preferred embodiment, adjacent one of the hinges 11, there is arranged a resilient mechanism 17, 18 (see FIG. 3) which will urge the flaps 8, 9 in any direction away form an intermediate position, i.e. either to the closed position or the open position. A major advantage of such an embodiment is that it allows for a simplified maneuver system of the flaps 8, 9, since it facilitates the use of the flow of water to move the flaps 8, 9 from the closed to the opened position, i.e. the flow will be force full enough to open the flaps at least half way, where after the resilient mechanism will safe guard the flaps moving into the full opened position. Hence no exterior maneuver device is needed to open and position the flaps 8, 9. Further, it facilitates the use of a closing device 10 of the maneuver system that merely has to move the flaps a limited range (e.g.)40-50° of the path of closing (e.g. 85-100°). Moreover, instead of using hydraulics in such an embodiment the use of a wire arrangement, for pulling the flaps may be preferable.

As shown in FIG. 1 the whole outlet area must not be blocked to obtain the desired function. A blocking of at least 50% is mostly needed and within the range of 60-95% may mostly be sufficient. More preferred, in most applications, the range of blocking is between 70-90%. In this regard it is to be understood that the invention is normally used for water jet propulsion units having a diameter at the outlet within the range of 0.3-3 m, but in future much larger diameters, e.g. 5 m, may come into use, to which the invention is applicable. Further it is an advantage in accordance with the invention to have the diameter of the outlet 5 to be about 55-75% of the inlet $D_7$.

The function of an arrangement according to the invention, with reference to FIGS. 1 and 2, is such that at start up, if the level of water is less than 50% of the inlet 7, the priming arrangement according to the invention will be activated. This may for instance be automatically arranged for, by providing sensors (not shown) measuring the level at the inlet 7 and providing input signals of activation if the level is within "priming range", e.g. 0.1-0.5 of $D_7$. As a consequence of activation the device (wire or hydraulic) for closing of the flaps 7, 8 will be activated and consequently close the flaps 7, 8, leading to locking of the outlet 5, e.g. in a range of 80-90%. Thereafter the impeller will be activated and as a consequence the water together with the air in the impeller housing will be forced out through the outlet 5. Thanks to the partial blocking of the outlet the water flow through the restricted passages at the outlet will hinder air from re-entering into the impeller housing. As a consequence the impeller will quickly be supplied with water through the inlet due to the negative pressure created by the impeller in the impeller housing. As soon as the impeller housing is filled with water the jet stream will increase drastically, substantially momentarily.

Thanks to a preferred aspect of the invention the hindering arrangement is such that the blocking effect thereof will automatically be eliminated by the power of the full jet stream. Accordingly the flaps 7, 8 will be forced out of their closed position into an unobstructing position. Hence, the blocking devices will automatically be moved out of a position where it otherwise could hinder the propulsive flow.

Further it is foreseen that the flaps 8, 9 may be arranged with further means to allow for an adjustability of the degree of blockage that is achieved in their blocking position. This may for instance be achieved by having the flap divided into two slidable units, to allow for the outer portion/edge thereof to be adjusted into different positions, allowing the range of blockage to be adjusted.

Further according to the preferred embodiment the flaps 8, 9 have the hinges 11 arranged on the outside of the outlet 5 and preferably in a plane that is upstream in relation to the plane of the outlet. Thanks to using exterior hinged flaps no influence will be made upon the flow upstream out of the impeller housing.

According to the embodiment shown in FIG. 2 the flaps 8, 9 are adapted to fit into the space delimited by a steering and reverse arrangement (not shown) that is normally fitted into the pivot points 2, 3, 15, 16 indicated in the Figs. As a consequence the space for movement of the flaps 8, 9 will be delimited by such a steering device. In this embodiment, at least the exterior corners 81, 82, 91, 92 are provided in a flexible material, e.g. polyurethane. Thanks to having these corner portions 81, 82, 91, 92 flexible the flaps 8, 9 may be retracted sufficiently out of the jet stream not to negatively affect the power output, by having the corners bent when they touch the inner walls of the steering device enclosing the space where the flaps 8, 9 are situated. Further it is shown that the flaps 8, 9 are also arranged with a curvature 83, 93 along the exterior vertical edge of each flap 8, 9, to allow for pivotal movements of the reversing device, as is known per se (not shown). By the two latter features it is feasible to block sufficiently a large amount of the opening of the nozzle 5 to not allow entrance of back flowing air at the same time as the flaps 8, 9 may be opened fully without disturbing the flow of the jet.

As mentioned above the hinge mechanisms may be provided with some kind of resilient mechanism 17, that will exert a resilient force to pivot the flaps 8, 9, both in the direction of its closing position as well as in the direction of being fully opened. As is generally well known there are several known principles that can be used to achieve this kind of resiliently urging mechanism to that has a kind of instable intermediate position (e.g. halfway open) where it will on one side of it urge the flap 8, 9 into its open position and on the other side of it will urge the flap to its closing position. An advantage is that then there is no need for any control mechanism to maneuver the flaps from its closed position to its opened position, which is especially advantageous regarding big, powerful water jets, since as soon as the impeller is working properly an enormous flow will occur and as a consequence a very high pressure will be exerted. If the flaps would not then be moved out of their closed position (e.g. due to an erroneous maneuver/control system) it is possible that they would be destroyed or removed from their positions. For movement of the flaps 8, 9 from their opened outer position to their closed position there is however a need to attach a pivotal force, which may be achieved in many different ways, e.g. by applying a wire within the tubes 12, 13 and pulling that wire to pivot the flaps 8, 9, inwardly, past the intermediate position.

Figure 3A:
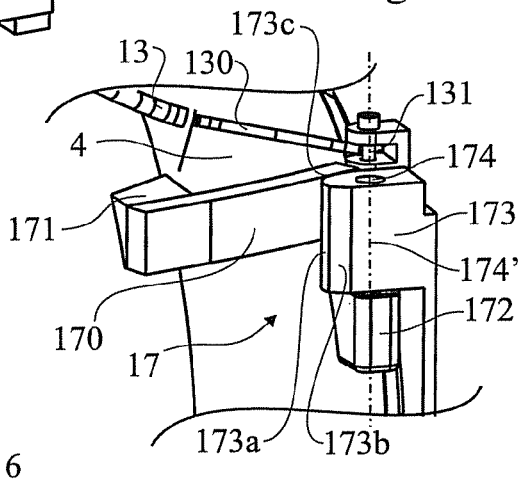

In FIG. 3 there is depicted one example of a resilient mechanism 17 in accordance with the invention. In FIG. 3, which is a perspective view seen from behind it is shown an embodiment where the flaps 8, 9 are closed. It can be noted that in this embodiment the flexible portions of the flaps 8', 9' are formed to fit to the circumference of the outlet 5, thereby merely leaving a non-blocked area in the vertically extending opening between the flaps 8, 9. Further in the detailed view of one of the resilient mechanism 17, FIG. 3A shows that there is at least one longitudinally extending resilient plate/leg 170 which is fixedly attached at one of its ends to the impeller housing 4, i.e. on the exterior side thereof. The plate 170 is fixed to extend substantially horizontally from the attachment point 171 rearwardly, to have its other end adjacent the outlet 5 and interacting with a camming mechanism 173*a*-173*c* of a first hinge part 173 attached to the flap 9. The hinge part 173 is arranged with a vertical through hole 174 adapted for pivoting of the flap 9 about a hinge stub of the second hinge half 172, that is fixed to the impeller housing 4. The camming surface is arranged such that an intermediate portion 173*a* thereof, is positioned further away from the pivotal axis 174' than those surfaces 173*b*, 173*c* being positioned on each side thereof. The surfaces are applied such that in any position at least one of the surfaces 173*a-c* will be in contact with the resilient plate 170. As a consequence the flap 9 will have an instable position by means of the resilient plate 170 when the intermediate surface 173*a* is in contact therewith. This surface 173*a* is positioned such that it is in contact with the plate 170 in a semi-opened/closed position of the flap 9. Therefore, as soon as the flap 9 is effected to move either way from that instable position, either by the wire 130 (having a pivotal attachment point 131, on the flap 9, but at a distance from the flaps pivotal axis 174') to get in contact with 173*c* or by the jet stream to get in contact with 173*b*, the flap will be urged into any of its fully opened or fully closed positions.

Figure 4:
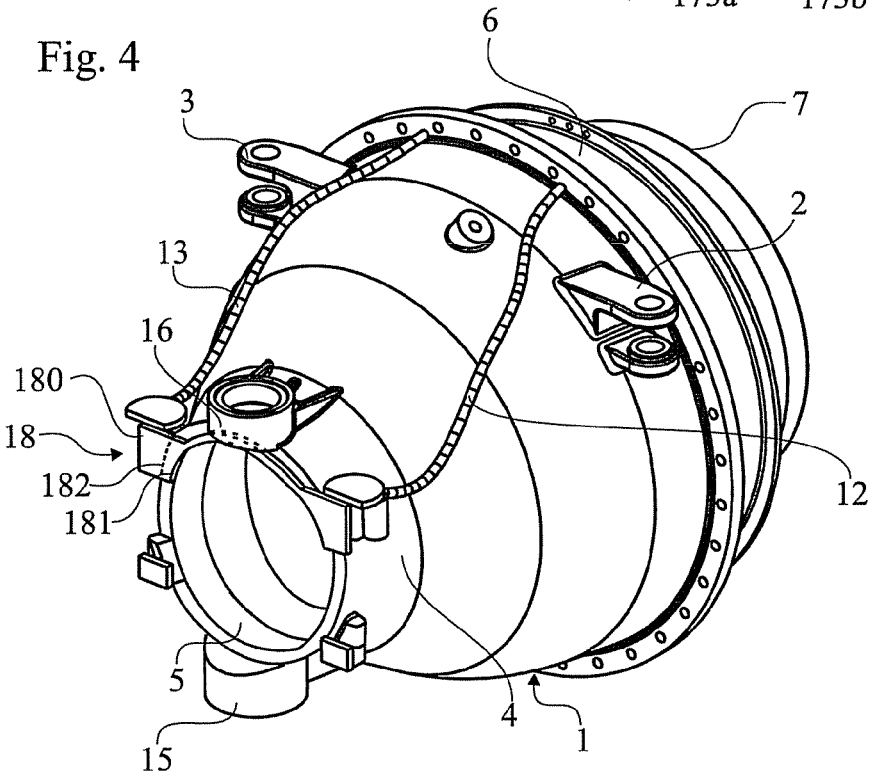
FIG. 4 is a perspective view of a further embodiment of a water jet propulsion unit according to the invention, including water curtain producing means to achieve the desired function.

According to a further embodiment indicated in FIG. 4 there is shown another principle to eliminate air to enter into the impeller housing via the outlet nozzle 4. Here the principle is based on supplying a curtain of flowing water by means of a water supply device 18. The water supply device 18 comprises a body 180 that extends along at least the main part of about 160° of the outlet nozzle 5. There is arranged a, preferably continuous, radially directed slot 181 for outlet of continuous curtain of water that covers at least substantially all of the outlet. Some kind of large supply channel 182 is preferably arranged within the body 180, to sufficiently distribute the added water for achieving a sufficient flow in said slot 181. Water to the water supply device 18 is supplied by any appropriate pumping means within the ship, e.g. separately installed pump, or from specifically designated supply pipe connected to any of the existing pumps of the ship, via appropriate supply channels, e.g. in the form of pipes/tubes 12, 13. Also some kind of tank mechanism may be used, since test have shown that the flow is merely needed for a short time, e.g. 30 seconds. Such a tank could e.g. be filled by a very small pumping mechanism in between the starts of the start of the water jet.

Somewhat, surprisingly it has been established by testing that also this kind of totally "un-blocking" principle may in some applications be sufficient to enable desired air hindering. As is understood this provides many advantages, e.g. no need to move any obstructing/blocking parts at inactivation, no need of mechanical parts that may wear.

The invention is not limited by what is described above, but may be varied within the scope of the claims. For instance, the skilled person realizes that flaps may be arranged in other ways than pivotal, e.g. sliding and that the size, number and configuration of the flaps may be varied within wide ranges and still fulfilling the function according to the invention. Further it is realized that flaps may be used also during propelling the ship, e.g. to influence the characteristic of the jet flow adjacent the outlet, which may have a beneficial effect, e.g. regarding power out put.

The invention claimed is:

1. A method of starting a water jet propulsion system for a ship, said propulsion system including a stator shell for mounting to a hull of the ship and having a nozzle ending in an outlet with a cross-sectional outlet area having a diameter of at least 0.3 m, an impeller housing attached to the stator shell and having an upstream inlet, and an impeller rotatably mounted in the impeller housing for receiving water from the inlet and discharging the water through the nozzle of the stator shell so as to create a water jet upon rotation of the impeller, said method comprising activation of at least one air back flow hindering flap adjacent the nozzle during a start up phase of the water jet propulsion system, wherein the hindering flap blocks at least 50% of said outlet area to limit air from entering into said impeller housing via said nozzle, and wherein the hindering flap has an exterior corner comprising a material that has a different flexibility than a hinge portion of the hindering flap.

2. The method according to claim 1, further comprising having said air back flow hindering flap arranged to move from the outside and inwardly in relation to a centre axis of said nozzle, when being moved into said blocking position.

3. The method according to claim 2, further comprising using a single impeller within said impeller housing.

4. The method according to claim 3, further comprising providing said back flow hindering flap to physically block less than 100% of said outlet nozzle and also using the jet flow from the impeller to hinder said air.

5. The method according to claim 4, wherein the at least one back flow hindering flap is mounted at the nozzle outlet and is movable between at least two positions, wherein one position blocks said outlet area.

6. The method according to claim 5, wherein said flap blocks at least 60-95%, and said flap is adjustable to vary an amount of blockage of said outlet area in their blocking position.

7. The method according to claim 6, further comprising providing at least two such flaps.

8. The method according to claim 7, wherein said flap, or flaps, is urged in at least one position by a resilient mechanism.

9. The method according to claim 4, further comprising providing a continuous curtain of water that hinders air from entering into said impeller housing via said nozzle.

10. A water jet propulsion system for a ship having a hull, said propulsion system comprising a stator shell for mounting to the hull and having a nozzle ending in an outlet with a cross-sectional outlet area having a diameter of at least 0.3 m, an impeller housing attached to the stator shell and having an upstream inlet, and an impeller rotatably mounted in the impeller housing for receiving water from the inlet and discharging the water through the nozzle of the stator shell so as to create a water jet upon rotation of the impeller, and means to activate an air back flow hindering flap during a start up phase of the water jet propulsion system, wherein the air backflow hindering flap in its activated state physically blocks at least 50% of said outlet area of said outlet nozzle, and wherein the hindering flap has an exterior corner comprising a material that has a different flexibility than a hinge portion of the hindering flap.

11. The system according to claim 10, wherein said air back flow hindering flap moves from the outside and inwardly in relation to a centre axis of said nozzle when being moved into said blocking position.

12. The system according to claim 11, wherein a single impeller is used within said impeller housing.

13. The system according to claim 12, wherein the air back flow hindering flap is mounted at the nozzle outlet and is movable between two end positions, wherein one position blocks said outlet area.

14. The system according to claim 13, wherein the nozzle outlet has an exterior, and said air back flow hindering flap is located on the exterior of the nozzle outlet.

15. The system according to claim 14, wherein said flap is pivotal on vertical axes.

16. The system according to claim 15, wherein said flap is at least partly urged by a resilient mechanism into its blocking position.

17. The system according to claim 16, wherein said flap is at least partly made in a flexible, resilient material.

18. The system according to claim 14, further comprising a slot that provides a continuous curtain of water that hinders air to enter into said impeller housing via said nozzle.

* * * * *